US007022016B2

(12) United States Patent
Wood et al.

(10) Patent No.: US 7,022,016 B2
(45) Date of Patent: Apr. 4, 2006

(54) VIDEO POKER GAME WITH BONUS AWARD FOR MATCHING DESIGNATED HANDS

(76) Inventors: Michael W. Wood, 11831 Wentling Ave., Suite #C, Baton Rouge, LA (US) 70816; John Edward Roethel, 4880 W. University Ave., Suite B-3, Las Vegas, NV (US) 89103

( * ) Notice: Subject to any disclaimer, the term of this patent is extended or adjusted under 35 U.S.C. 154(b) by 522 days.

(21) Appl. No.: 09/923,675

(22) Filed: Aug. 6, 2001

(65) Prior Publication Data

US 2002/0034974 A1 Mar. 21, 2002

Related U.S. Application Data

(60) Provisional application No. 60/223,579, filed on Aug. 7, 2000.

(51) Int. Cl.
*A63F 9/24* (2006.01)

(52) U.S. Cl. ..... 463/13

(58) Field of Classification Search ..... 463/13, 463/16–20, 25–26; 273/138.1, 292, 139, 273/273

See application file for complete search history.

(56) References Cited

U.S. PATENT DOCUMENTS

| | | | | |
|---|---|---|---|---|
| 5,935,002 | A * | 8/1999 | Falciglia | 463/19 |
| 5,957,774 | A * | 9/1999 | Holmes et al. | 463/13 |
| 6,089,976 | A * | 7/2000 | Schneider et al. | 463/16 |
| 6,164,652 | A * | 12/2000 | Lauretta et al. | 273/292 |
| 6,227,969 | B1 * | 5/2001 | Yoseloff | 463/13 |
| 6,390,921 | B1 * | 5/2002 | Busch et al. | 463/42 |
| 6,481,713 | B1 * | 11/2002 | Perrie et al. | 273/146 |
| 6,568,680 | B1 * | 5/2003 | Moody et al. | 273/292 |
| 6,569,013 | B1 * | 5/2003 | Taylor | 463/13 |
| 6,569,014 | B1 * | 5/2003 | Walker et al. | 463/13 |

* cited by examiner

*Primary Examiner*—Kim Nguyen
(74) *Attorney, Agent, or Firm*—John Edward Roethel

(57) ABSTRACT

During the play of a session of video poker, one or more playing cards, either as simply a group of cards or as recognizable poker hands, are designated and shown to the player on the video screen of the gaming machine. As the playing cards are dealt to the player during the play of the regular video poker game, each dealt card that corresponds to one of the designated cards results in a match of the designated card. The designated card that has been matched is shown by highlighting the matched card on the video screen. When the player has matched all of the designated cards, the player receives a bonus award. The amount of the bonus award is based on the number of deals of video poker that it took to match all of the designated cards.

7 Claims, 3 Drawing Sheets

VIDEO POKER GAME WITH BONUS AWARD FOR MATCHING DESIGNATED HANDS

CROSS-REFERENCE TO RELATED APPLICATION

This application is based on and claims the benefit of U.S. Provisional Application Ser. No. 60/223,579, filed Aug. 7, 2000.

This application relates to a method of playing video poker and more particularly to a method of playing video poker in which the player must match one or more particular predetermined playing cards or poker hand rankings during the play of the regular video poker game. This is done by tracking the cards dealt on the initial five card hand until the particular playing card or cards or video poker hand or hands is achieved. This feature is played in conjunction with regular video poker over a series of video poker hands and the player is awarded a bonus payout when he achieves the cards necessary to win the bonus award.

BACKGROUND OF THE INVENTION

A well known game of chance offered to players in most gaming casinos is video draw poker. After making a wager, the player is dealt five cards face up. The player selects which cards, if any, the player wishes to hold, the unheld cards are discarded and replacement cards are dealt for the discarded cards. The final five card hand is analyzed to determine its poker hand ranking and the player is paid for winning poker hand rankings based on the amount of the player's wager. A pay table is displayed to the player showing the amounts that the player can win based on the poker hand ranking achieved by the player and the amount wagered by the player.

Bonus game features have also been added to video poker. In one known bonus game, video poker is combined with a game of bingo. A bingo card is shown in a video screen display adjacent to the video screen on which the regular game of video poker is played. Each of the spots on the bingo card is designated as a particular poker hand ranking, such as Four Aces, a Pair of Jacks, a Spade Flush, etc. and the center spot is a Free Space as is traditional in bingo. Whenever the player achieves one of the designated poker hand rankings as a final hand during the play of the regular video poker game, the corresponding spot on the bingo card is marked—such as by highlighting the spot. When the player achieves a winning play on the bingo card (such as completing a row, column, diagonal or the four corners), the player wins a bonus award. The spots that comprise the winning arrangement are unmarked—such as by unhighlighting the spots—and the bonus feature continues with the other highlighted spots carrying over.

There is a need in the gaming industry to provide new and exciting games for the players to maintain interest in casino gaming. It is an object of the present invention to provide players with a bonus feature that is played in conjunction with a regular video poker game so that the player has the chance to win a bonus payout award during the course of play of video poker.

It is a feature of the present invention to initially designate one or more playing cards, either as simply a group of cards or as recognizable poker hands, and the designated cards are displayed to the player. As the playing cards are dealt to the player during the play of regular video poker, each dealt card that corresponds to one of the designated cards results in a match of the designated card and the match is shown by highlighting the designated card that has been matched. When the player has matched all of the designated cards, the player receives a bonus award.

It is an advantage of the present invention that the player will receive additional payouts based on the length of time that the player plays the gaming machine. This will encourage the player to play the gaming machine for a longer time and add an additional entertainment feature to the gaming machine. This also adds a form of entertainment to the game of video poker since the player will have a rooting interest watching the designated cards being matched over the course of the deal of the playing cards. The bonus feature does not affect the play of the regular video poker game.

Other objects, features and advantages of the present invention will become apparent from a consideration of the following detailed description.

SUMMARY OF THE INVENTION

During the play of a session of video poker, one or more playing cards, either as simply a group of cards or as recognizable poker hands, are designated and shown to the player on the video screen of the gaming machine. As the playing cards are dealt to the player during the play of the regular video poker game, each dealt card that corresponds to one of the designated cards results in a match of the designated card. The designated card that has been matched is shown by highlighting the matched card on the video screen. When the player has matched all of the designated cards, the player receives a bonus award. The amount of the bonus award is based on the number of deals of video poker that it took to match all of the designated cards.

DETAILED DESCRIPTION OF THE PREFERRED EMBODIMENTS

The present invention adds a bonus feature to the method of play of conventional video poker. In conventional video poker, a player makes a wager to be able to play a hand of cards. After making the wager (which can be any number of coins, tokens or credits, but is usually a maximum wager of five credits), the player is dealt five cards face up. These first five cards are the player's initial hand or starting hand.

The player selects which cards, if any, the player wishes to hold from his initial hand. The unheld cards are discarded and replacement cards are dealt for the discarded cards. The final five card hand is analyzed to determine its poker hand ranking and the player is paid for winning poker hand rankings based on the amount of the player's wager. A pay table is displayed to the player showing the amounts that the player can win based on the poker hand ranking achieved by the player and the amount wagered by the player.

The feature of the present invention can be applied to any video poker formats such as Draw Poker, Deuces Wild Poker, Bonus Poker, Double Bonus Poker, Double Double Bonus Poker, Triple Bonus Poker, Joker's Wild Poker or any of the myriad of video poker formats that have been developed. Each of these video poker formats uses various arrangements of poker hand rankings as winning combinations and they use various payout amounts for the poker hand rankings. The amounts paid for the various winning hand combinations in each of the video poker formats are calculated to provide a certain theoretical game return which is generally in excess of 90%.

Figure 1:
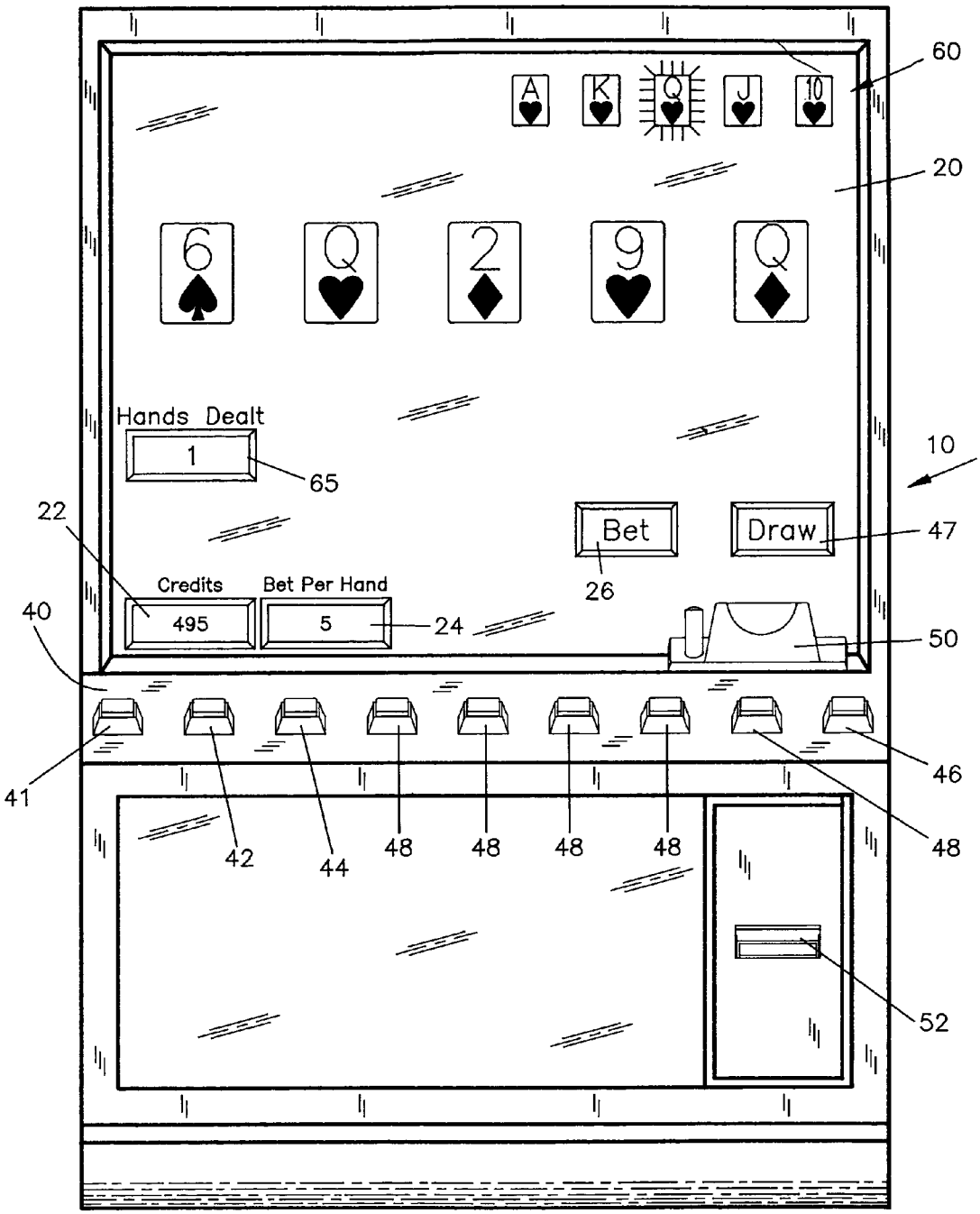
FIG. 1 shows a gaming machine configured to operate the method of the present invention with the first initial deal of cards shown.

FIG. 1 shows a gaming machine upon which the method of the present invention can be carried out. The gaming machine 10 includes a video screen display 20 on which is shown the playing cards that will be used during the play of the method of the present invention. The video screen display 20 also includes other information and data presented to the player to allow the player to understand the play of the game and to effect the operation of the method.

In the preferred embodiment of the present invention, the video screen display shows a credit meter 22 and a display of the total number of credits 24 wagered for a particular round of play of the game. The video screen display also has touch screen locations to allow the player to DRAW 47 replacement cards and to make his initial wager, which can be made one credit at a time using the BET ONE location 26 or which can be made by wagering the maximum number of credits allowed by the gaming machine using the BET MAX location (not shown).

Each of the card locations on the video screen display can also be touch screen locations so that the player may designate which cards he wishes to hold by merely touching the card location on the video screen display 20.

The gaming machine 10 also has a button panel 40 which includes typical buttons that the player may press to activate various actions during the play of the method of the present invention. A CASH OUT button 41 is provided to allow the player to collect any credits which the player has accrued on the credit meter 22. A BET MAX button 42 and a BET ONE button 44 are provided to allow the player to wager either the maximum amount of credits or to wager one credit at a time on the play of the game as desired by the player. A DRAW button 46 is provided to allow the player to effect the draw step of the method of play as desired should the player prefer to use the button panel instead of the DRAW touch screen location 47 on the video screen display 20. A plurality of HOLD buttons 48 are also provided to allow the player to select which cards the player wishes to hold should the player prefer to use the button panel instead of the card touch screen locations on the video screen display 20.

In the preferred embodiment of the present invention, when the initial five card hand is displayed on the video screen display 20, the player must choose which cards to hold by either pressing the card location on the touch screen or by pressing the HOLD button associated with the card position.

The gaming machine 10 also includes a coin head 50 to allow the player to insert coins or gaming tokens as wagers to allow play of the gaming machine 10. A bill acceptor slot 52 is also provided on the gaming machine 10. In order to accrue credits that may be used to play the gaming machine 10, the player inserts paper currency or other suitable script or gaming coupons into the bill acceptor slot 52 behind which, on the interior of the gaming machine, is mounted a bill acceptor which takes in and validates the currency. The monetary value of the inserted currency is then applied to the credit meter 22, the credits on which the player may use to play the gaming machine.

The video screen display also includes a BONUS CARDS location 60 at which the designated cards are shown. These are the cards that the player will attempt to match during the play of video poker in order to win the bonus award. A HANDS DEALT location 65 also tracks the number of hands dealt until the player has achieved a match of all of the designated cards.

Any other conventional and suitable equipment can be included in the gaming machine.

In the method of the present invention, one or more playing cards, either as simply a group of cards or as recognizable poker hands, are designated and shown to the player on the video screen of the gaming machine. Any suitable number of cards can be designated as the cards to be matched. The designated cards can be a recognizable poker hand, such as a Heart Royal Flush (which would be five cards), the four Aces and four Kings (which would be eight cards), or even all of the Spades (which would be thirteen cards). Alternatively, the designated cards can be a simply a subset of the entire fifty-two card deck—say ten cards selected at random. Using a recognizable poker hand makes it easy for the player to know which cards he needs to be dealt in order to win the bonus award and thus makes it easy for the player to root along while he plays the regular video poker game.

After the cards to be matched have been designated, the playing cards for the regular video poker game are dealt and displayed to the player. Each dealt card that corresponds to one of the designated cards results in a match of the designated card. The designated card that has been matched is shown by highlighting the matched card on the video screen.

Figure 2:
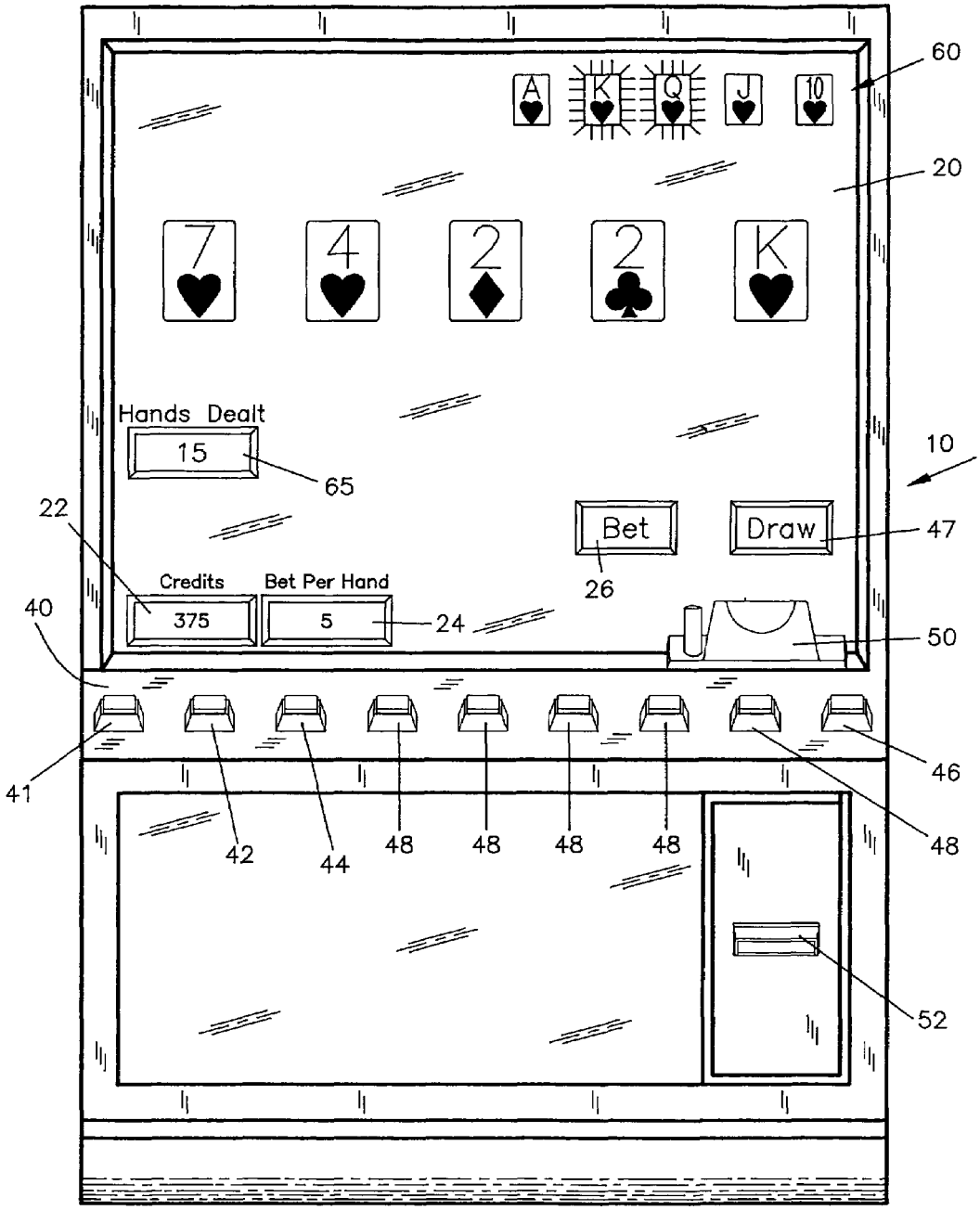
FIG. 2 shows a gaming machine configured to operate the method of the present invention with the fifteenth initial deal of cards shown.
Figure 3:
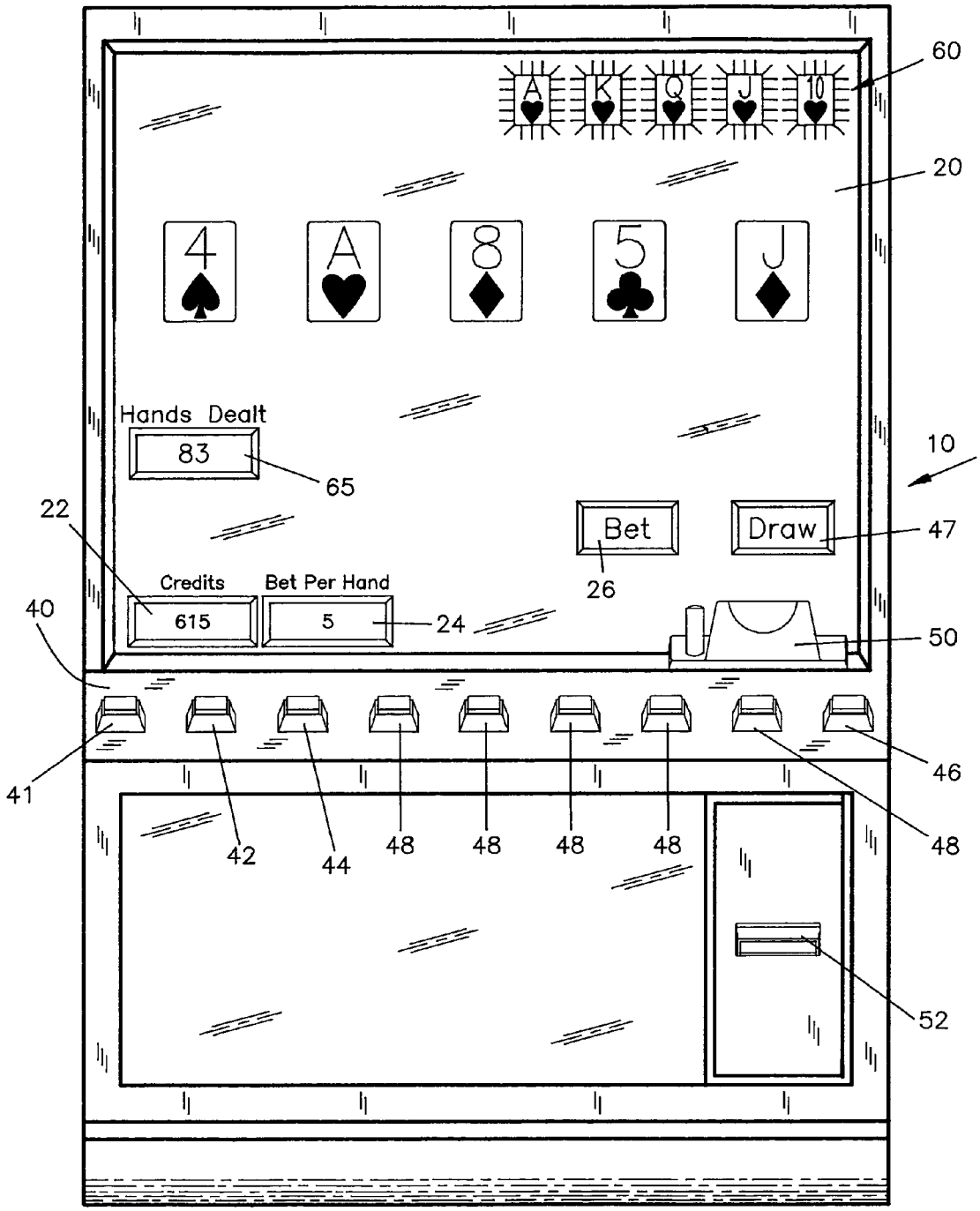
FIG. 3 shows a gaming machine configured to operate the method of the present invention with the eighty-third initial deal of cards shown.

An example of the method of play is shown in FIGS. 1–3. In FIG. 1, the BONUS CARDS location 60 shows that the cards designated are the Ace of Hearts, King of Hearts, Queen of Hearts, Jack of Hearts and Ten of Hearts (the Heart Royal Flush). The HANDS DEALT location 65 shows this as the first hand being dealt.

The initial five card hand dealt to the player in the regular video poker game is the Six of Spades, the Queen of Hearts, the Two of Diamonds, the Nine of Hearts and the Queen of Diamonds. There is one matching card of the initially dealt hand with the designated cards—the Queen of Hearts. As shown in FIG. 1, the Queen of Hearts is marked off in the BONUS CARD location 60 in any suitable manner, for example the Queen of Hearts can be highlighted to show that it has been matched.

The player then plays out his regular video poker hand in the conventional manner and winning final hands are paid and losing final hands are lost.

The player then continues to play video poker in the conventional manner with winning and losing plays being handled accordingly. Prior to the start of each hand of play, the cards are shuffled and an initial five card hand is dealt and displayed to the player. Whenever one of the designated cards is displayed to the player during the initial deal of the cards in the regular video poker game, the corresponding card is marked off in the BONUS CARD location 60. Each initial deal of the cards increments the HANDS DEALT location 65.

Continuing with the example, FIG. 2 shows that on the 15th deal of the initial cards, the player has been dealt the Seven of Hearts, the Four of Hearts, the Two of Diamonds, the Two of Clubs and the King of Hearts. The King of Hearts is a matching card so it is marked off and joins the Queen of Hearts as highlighted cards in the BONUS CARD location 60. The HANDS DEALT location 65 shows 15 as the number of hands dealt so far.

Again the play of the regular video poker game continues. Eventually, all of the designated cards to be matched will have been dealt on the initial deal of the regular video poker game.

As shown in FIG. 3, the player has been dealt on the 83rd deal the Four of Spades, the Ace of Hearts, the Eight of Diamonds, the Five of Clubs and the Jack of Diamonds. Thus, the player has finally achieved all of the five Heart Royal Flush since all five of the designated cards have been marked off by highlighting in the BONUS CARD location 60. The player thus wins the bonus award for having matched all of the designated cards.

The bonus award won by the player can be determined by the number of HANDS DEALT it took for the player to match all of the designated cards. Any suitable payout scheme can be used for the bonus award.

In the preferred embodiment of the present invention, a pay table is determined that groups the number of HANDS DEALT based on the mathematical probability of achieving a match of the designated cards over a series of initial deals of five cards from a randomly shuffled deck of fifty-two cards. A representative pay table is shown in Table 1:

TABLE 1

| NUMBER OF HANDS DEALT | BONUS AWARD |
|---|---|
| 1–5 | 500 |
| 6–12 | 25 |
| 13–75 | 0 |
| 76–99 | 300 |
| 100–129 | 1000 |
| 130 OR MORE | 4000 |

With regard to the example shown in FIGS. 1–3, it took the player until the 83rd hand to complete the match of all of the designated cards, so the bonus award to the player would be 300 credits. The bonus award can be paid to the player in any suitable manner, such as merely adding the 300 credits to the credit meter 22.

Once the player has achieved the match of all the designated cards, the BONUS HAND location 60 resets all of the cards to the unhighlighted condition and the HANDS DEALT location 65 resets to zero. The bonus award feature thus resets to the beginning and the matching of designated cards and counting of dealt hands begins anew.

In one embodiment of the present invention, the same designated cards are used as the bonus award cards when the game is reset. In another embodiment of the present invention, a different group of designated cards are used each time the game resets. The designated cards can be randomly selected each time the bonus award is reset, preferably from a preselected collection of designated card groups—e.g. each of the four Royal Flushes (Spades, Hearts, Diamonds and Clubs) can form the preselected collection and one of these Royal Flushes is randomly selected to be the designated cards each time the bonus award feature is reset.

The pay table shown in Table 1 is only representative of any of a myriad of pay tables that can be used. This pay table is also based on the assumption that the player is not required to make an additional wager to be eligible for this bonus award feature. In another embodiment of the present invention, the player can be required to make a separate wager of any suitable amount, say one credit, to be eligible for the bonus award and the moneys generated by this separate wager can be used to fund the bonus award pay table. This would allow much higher bonus awards to be paid to the player.

In the example shown in FIGS. 1–3, the designated cards to be matched were five in number. If a different number of cards were used as the group of designated cards, then the pay table would have to be adjusted to reflect the change in probability that occurs when the group of designated cards was more or less than five cards.

It is also possible to practice the method of the present invention using a deck of cards that has one or more Jokers added thereto. In such a situation, it would be necessary to adjust the pay table to reflect the change in probability that occurs when the deck of playing cards has more than fifty-two cards.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a video poker game having a bonus award feature comprising:

a) establishing a predetermined arrangement of cards as a winning bonus award;

b) dealing a first initial five card hand to a player;

c) determining whether any of the first initial five cards match any of the predetermined arrangement of cards and if any matches occur, noting the matched cards;

d) allowing the player to play out the first initial five card hand according to the conventional manner of play of video poker;

e) continuing to deal subsequent initial five card hands and determining whether any of the cards of each subsequent hand match any of the predetermined arrangement of cards and noting the matched cards;

f) continuing to allow the player to play out each of the subsequent initial five card hands according to the conventional manner of play of video poker; and g) when all the predetermined arrangement of cards have been matched, determining whether the player has achieved a bonus award.

2. The method of claim 1 in which the player makes a wager to be eligible to participate in the video poker game.

3. The method of claim 2 in which the player receives a bonus award based on the number of initial five card hands that are dealt in order for all of the predetermined arrangement of cards to be matched.

4. The method of claim 3 in which the bonus award is based on a pay table.

5. The method of claim 4 in which the pay table comprises:

| NUMBER OF HANDS DEALT | BONUS AWARD |
|---|---|
| 1–5 | 500 |
| 6–12 | 25 |
| 13–75 | 0 |
| 76–99 | 300 |
| 100–129 | 1000 |
| 130 OR MORE | 4000. |

6. The method of claim 1 in which the predetermined arrangement of cards is five cards.

7. The method of claim 6 in which the predetermined arrangement of cards is a Royal Flush.

* * * * *